US005596815A

United States Patent [19]

Rice et al.

[11] Patent Number: 5,596,815

[45] Date of Patent: Jan. 28, 1997

[54] MATERIAL DRYING PROCESS

[75] Inventors: Garland G. Rice, Atchison, Kans.; David H. Long, Springfield, Ohio

[73] Assignee: Jet-Pro Company, Inc., Atchison, Kans.

[21] Appl. No.: 252,999

[22] Filed: Jun. 2, 1994

[51] Int. Cl.[6] ..... F26B 3/00; F26B 7/00

[52] U.S. Cl. ..... 34/346; 34/378; 34/382; 34/387

[58] Field of Search ..... 34/61, 381, 382, 34/385, 387, 345, 346, 353, 377, 386, 334, 378

[56] References Cited

U.S. PATENT DOCUMENTS 4,082,532 4/1978 Imhof ..... 34/387
4,098,006 7/1978 Maffet ..... 34/61
4,161,825 7/1979 Maffet ..... 34/385
4,829,678 5/1989 Glorioso ..... 34/378
5,161,315 11/1992 Long ..... 34/57

*Primary Examiner*—Henry A. Bennett
*Assistant Examiner*—Susanne C. Tinker
*Attorney, Agent, or Firm*—Robert E. Stebens

[57] ABSTRACT

A process is provided for drying raw material that comprises solids and a substantial amount of moisture. The process in its basic form involves the steps of forming the raw material into pellets by extrusion under pressure through a forming die into pellets with the solids compacted into a cohesively secured mass and then drying the pellets thus formed to reduce the moisture to a desired percentage. Raw material that has an excessive amount of moisture such that they cannot be extruded are first mixed with a dry material to reduce the moisture content to the point where they can be extruded.

2 Claims, 4 Drawing Sheets

LIQUID
RAW MATERIAL
50
COAGULATOR
51
MIXER
PELLETIZER
52
53
DRYER
COOLER
54
DRIED
PRODUCT
GRINDER
55

MATERIAL DRYING PROCESS

FIELD OF THE INVENTION

This invention relates, in general, to a process for drying of materials comprising solids and a significant amount of moisture, such as water, that is either combined with the solids as a mixture or which may be integrally incorporated with the solids. It relates, more particularly, to a process for effecting removal of moisture from a solids base material by forming the material into a compacted mass of a pellet-form configuration and then passing heated air around the pellets to effect removal of moisture by vaporization of moisture carried on the exterior of the pellets, as well as that which is incorporated in the pellets and the particles of solids included in the pellets.

BACKGROUND OF THE INVENTION

Many techniques and procedures utilized in processing of diverse materials to obtain a particular end product also result in formation of a residue or by-product containing a high proportion of moisture. Such residue or by-products collectively termed "residual products" must be disposed of by methods or techniques that satisfy ecological standards and safety requirements. However, these residual products, because of their high moisture content, present disposal problems. Some residual products contain significant nutrient value so that they could be utilized as livestock, animal or poultry feed, or as agricultural fertilizer, but a high moisture content makes them difficult and costly to handle and utilize for those purposes and they are often simply disposed of as useless waste. For the same reason, a number of residual products that have potential as a source of energy can only be consigned to ultimate disposal such as in landfills. Generally, these residual products have a moisture content that is so proportionally high with respects to their solids, that they are not susceptible to economically feasible further processing to a state that permits their utilization.

One type of drying apparatus that has been utilized to effect drying of high moisture content materials is the, spray dryer. With this apparatus, the material to be dried is sprayed into a confined space through which heated air is caused to flow and effect vaporization of moisture from the material, leaving dry solids with the vaporized moisture being exhausted to the atmosphere. While a spray dryer can effect drying of some high moisture content materials, it accomplishes this drying with input of a relatively large amount of energy in the form of heat, and also mechanical, to cause a flow of large quantities of air at high velocity. Consequently, spray drying is a costly technique that cannot be economically justified for many residual products.

Another type of drying apparatus that has been utilized for drying of some high moisture content materials is the fluidized bed dryer. A fluidized bed dryer has a bedplate formed with apertures and on which the moist materials are placed. Heated air is caused to flow upwardly through the apertures and the material at volumes and velocities to effect fluidizing of the material with the objective of vaporization of the moisture. This technique does not work well with some materials as moist solids tend to agglomerate into large masses. The fluidizing heated air has difficulty in penetrating these agglomerated masses and, thus, the agglomerated material retains moisture in the interior of those masses and they are only dried on the outside. When these agglomerated masses of material are processed through the dryer, the retained moisture will move to their exterior, become sticky and tend to stick to subsequent processing apparatus as well as being an unacceptable, unusable product and which may cause the entire mass to spoil.

In particular, techniques previously used to effect drying of many organic materials have not found widespread use for economic reasons. The techniques for removal of the moisture have generally required input of substantial energy, primarily in the form of heat to effect vaporization of the moisture and enable it to be removed from the body of material. Organic materials, when processed by prior techniques, often exhibit a strong tendency to agglomerate into large masses that further hinders their drying.

Typical of the materials which are particularly adapted to the processing technique of this invention are the by-products that are produced from such processing operations in producing poultry products for human consumption and also in processing of milk products where a generally unutilizable material such as whey may be produced. Also, residue materials from slaughterhouse operations are often incapable of being readily used for production of food products, such as for cats and dogs, as they contain excessive amounts of moisture. Materials of that nature are difficult and uneconomical to process as the residual moisture content requires employment of preservation techniques such as refrigeration, in many cases, to maintain the product in a palatable state for consumption by animals. This problem is further compounded by the fact that materials containing high levels of moisture are normally only susceptible to storage for relatively short periods of time unless they are refrigerated or processed into storage containers that are suitable for preserving the contents. The requirement for utilization of such containers further compounds the problems of processing such materials as the containers represent a significant economic factor. Transportation of high moisture content materials is also economically disadvantageous.

SUMMARY OF THE INVENTION

In accordance with this invention, the process basically comprises sequential steps of first forming the raw material into a compressed state and to then subsequently subject the compressed material, which is then in a semisolid state, to heating to effect essentially complete removal of the moisture. An essential first step in the operation of this process is the compression of the raw materials which comprises material which contains a relatively large percentage of moisture into a semisolid state that has significant structural integrity. That intermediate product is then subjected to a heating operation to effect vaporization of the remaining moisture and when thus vaporized, effect its removal, leaving the material as the end product in a form that has structural integrity. The product, when thus processed by this invention technique, is sufficiently moisture-free to permit it to be stored for relatively long time periods and easily and economically transported to a place of utilization. Many of these products, such as the food-type products for animal consumption, can be subsequently recombined with water to change the state of the material to a condition that may be more palatable to the specific animals that will be consuming the material. In the case of organic materials designed for use as agricultural fertilizers, the dried product may simply be distributed on the ground area where desired to provide nutrients to the vegetation that will be grown. Some end products in this dry state can be burned as an energy source.

The process is particularly adapted to materials having a moisture content such that the raw material may be formed into structural entities that will withstand significant mechanical stress or forces and maintain a mechanical integrity for the drying operations.

The process of this invention is also readily adapted to drying materials that have a relatively high moisture content and which, in their original state, cannot be formed into a semisolid mass such as pellets that can be subjected to a subsequent heating operation to effect vaporization of the moisture. Drying of such materials by this modification of the inventive process is effected by initially mixing the raw material with material that is in a relatively dry state and is either of the same kind or compatible character and is susceptible to producing a desired end result combination. For example, by preliminary operations, a specific base raw material may be subjected to a drying operation to reduce the moisture content to the point where the material is considered to be relatively dry. That material can then be combined with the raw material having the high moisture content to produce a resultant material having a solid and liquid composition such that it can be mechanically formed into a structural form that has structural integrity and will resist moderate mechanical forces while preserving a structural configuration for the subsequent drying operation.

A further modification of this drying process is capable of effecting drying of materials that are essentially liquid in their initial or raw state, but which do include solids, although in relatively small proportion. This modification of the drying process is functional to effect drying of materials that have an initial moisture content of the order of 95%. In accordance with this modification, the raw material is first subjected to operation that reduces the moisture content to a proportion that is less than 80% and preferably in the range of 50–70%. Depending on the characteristics of the raw material, this first step may be effected by a coagulation process or by a chemical agglomeration process. Following this initial step, the material is mixed with a quantity of dry material to effect a further reduction in the moisture content as in accordance with the previously described modification of the process. That mixing step is then followed by the compacting and forming step and the drying step of the basic process. This modification of the process is particularly useful in processing of animal blood from slaughterhouse operations to produce a dried product that can then be utilized as a constituent in certain animal feeds.

These and other objects and advantages of this invention will be readily apparent from the following detailed description of illustrated processing techniques of this invention. To assist in understanding the processing operation, diagrammatic illustrations of equipment and apparatus to facilitate the process are shown in the accompanying drawings.

DESCRIPTION OF THE DRAWING FIGURES

DESCRIPTION OF THE ILLUSTRATIVE TECHNIQUES OF THE INVENTIVE PROCESS

A basic process of the invention is described as it relates to processing of organic materials. An example of a typical organic material that is particularly adapted to processing in accordance with this invention is meat by-products such as those resulting from a poultry processing operation. However, the process of this invention is not to be considered limited in its application to only processing of organic materials such as meat by-products. As will become apparent from subsequent description of modified process techniques of the invention, the inventive process is adapted to processing of many diverse materials. The processing technique may also be utilized to great advantage in drying of non-organic materials such as chemical based materials. A common characteristic of materials with which this process is designed to be utilized is that those materials, in their basic or raw state, comprise a significant proportion of moisture such as moisture in the form of water.

A further common characteristic of the materials to be dried in accordance with the inventive process is that those materials do include constituents that are in the form of solids and which ultimately are best handled for ultimate use or disposal when they are sufficiently dried by removal of a significant proportion of the moisture or water, leaving primarily solids that are better adapted to a particular use or for further processing. More specifically, the process is adapted to handling of materials which, in a raw state, may have a moisture content that exceeds at least 20% by weight and may well be in the range of 90–95% moisture by weight proportion. These materials are dried to reduce the moisture content to be of the order of 10% by weight and may well be in the range of 5–10%, or even less than 5%, when the drying process is completed.

Figure 1:
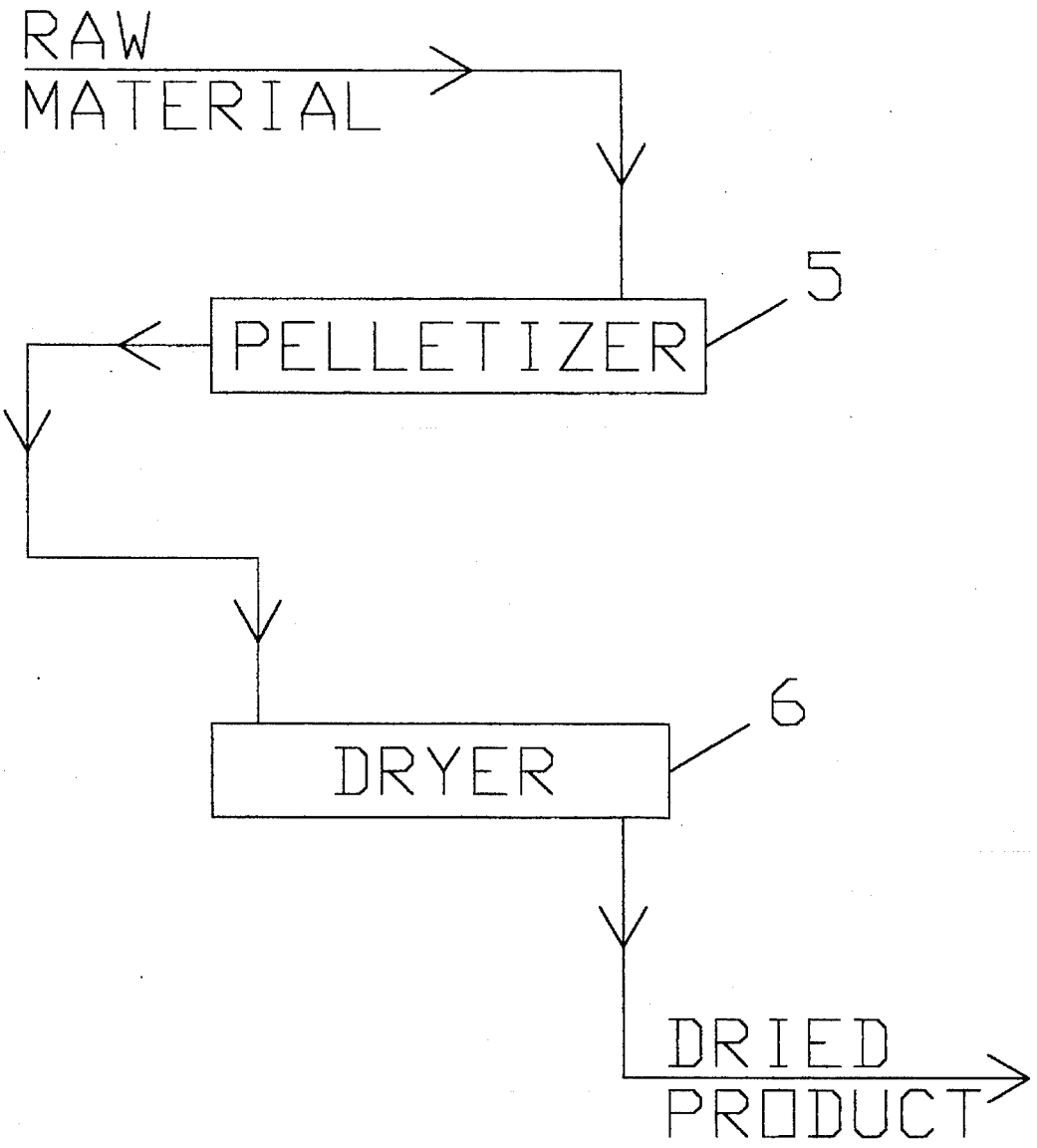
FIG. 1 is a diagram of the sequential steps of the basic process of this invention.
Figure 4:
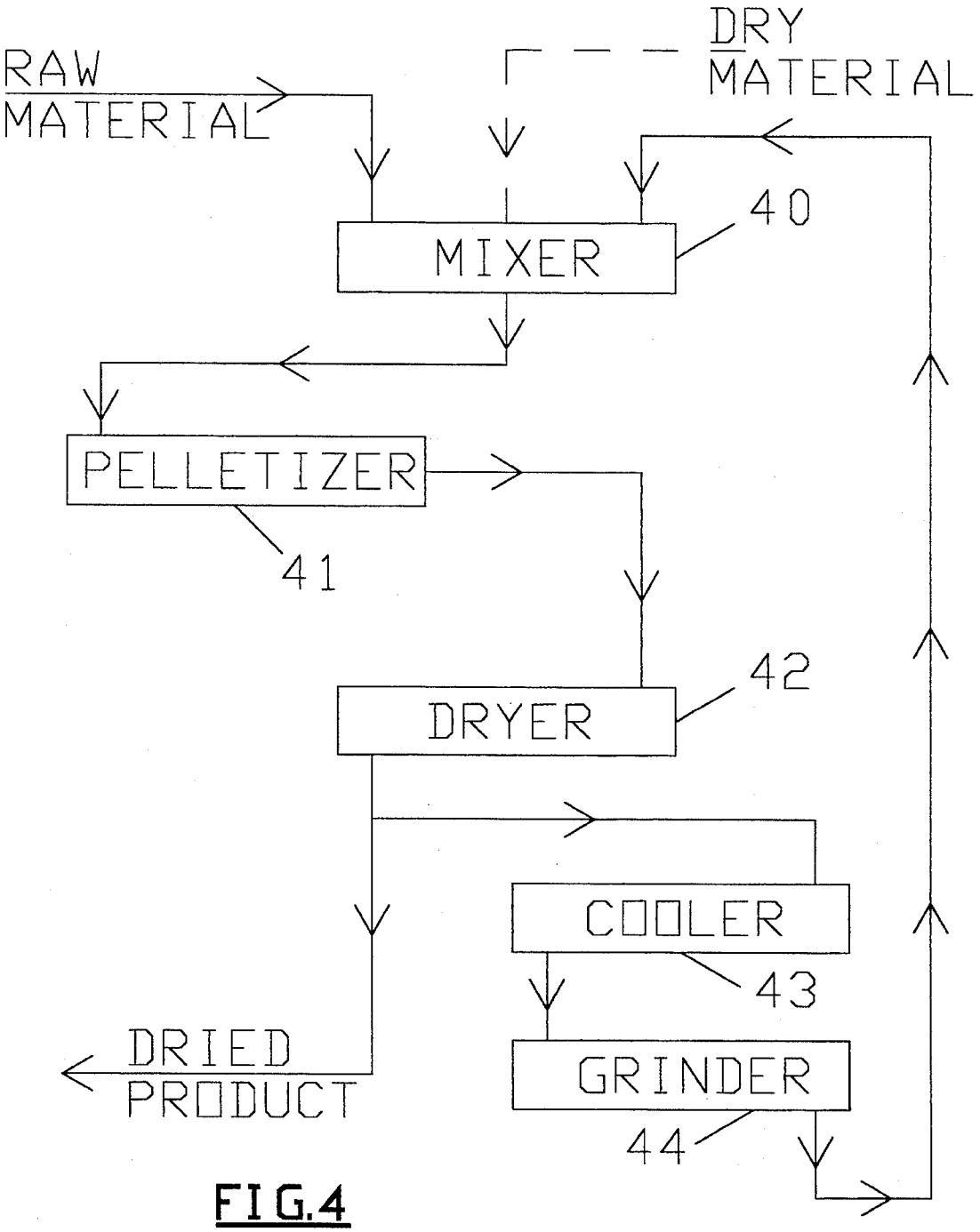
FIG. 4 is a diagram of the sequential steps in modification of the process of this invention.
Figure 5:
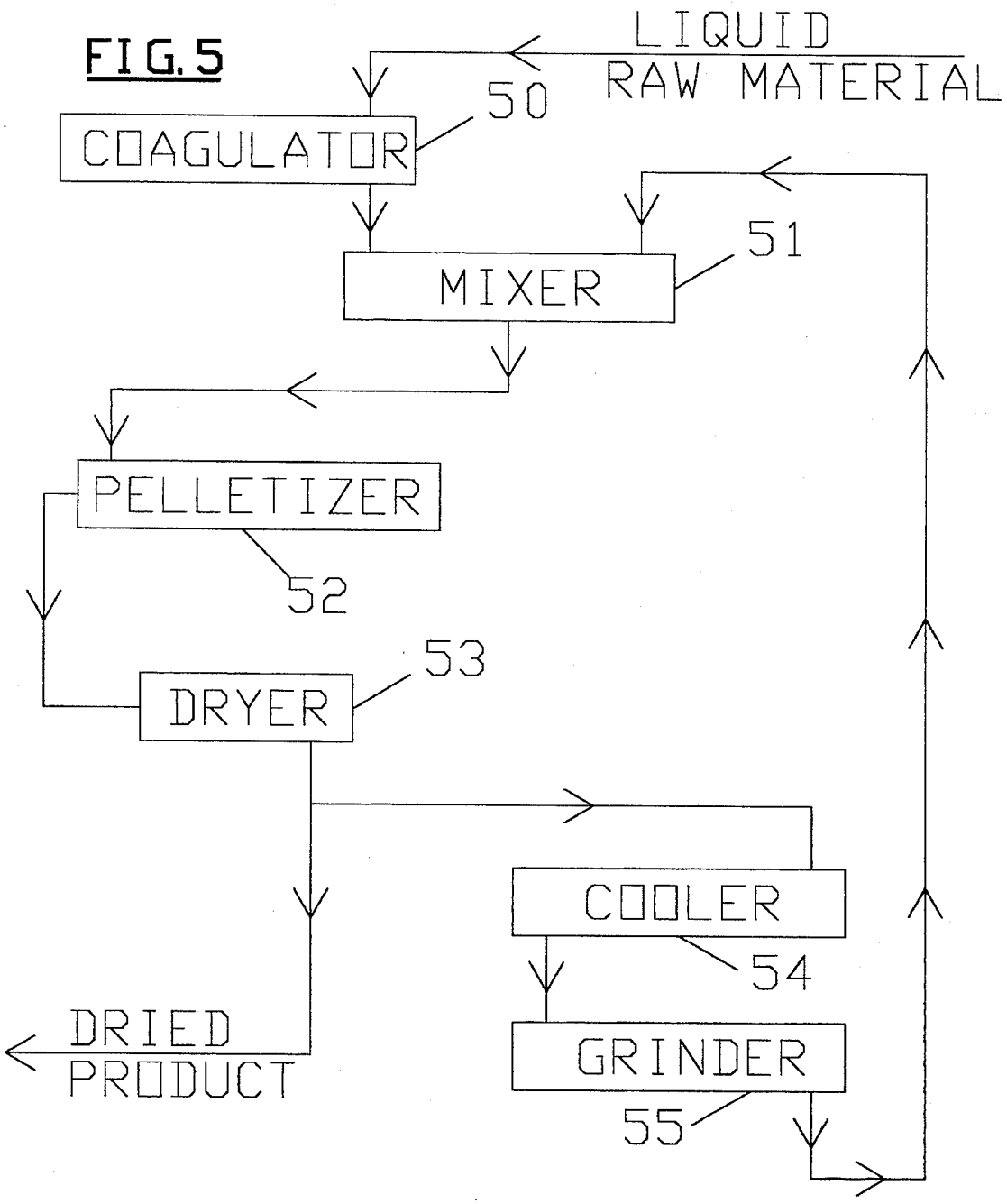
FIG. 5 is a diagram of the sequential steps in another modification of the process of this invention.

This basic form of the process is illustrated in FIG. 1. This process diagram illustrates the sequence of the steps in the process. Neither FIG. 1 nor the process diagrams of FIGS. 4 and 5 are intended to indicate a physical flow path interconnection between specific apparatus components that effect respective procedures of the process. Specific techniques of transferring the materials into the first processing apparatus or from one processing apparatus to another, or from the last processing apparatus, are determined by characteristics of the material at any particular stage in the process. In this process, the raw material is first subjected to an operation which results in formation of the material into physical bodies of a particular configuration termed herein as "pellets" that have a certain degree of mechanical integrity and are able to maintain a physical embodiment or configuration. This step of the process is termed as "pelletizing" and is effected by appropriate apparatus designated as a "pelletizer" and is indicated in FIG. 1 by the numeral 5. After formation of the raw material into pellets, as will be subsequently described in greater detail, those pellets are then subjected to a drying operation. This is effected by an apparatus designated in the drawings by the numeral 6 as a "dryer". A dryer that is suitable for performance of this drying operation is also subsequently described in greater detail to better illustrate this step of the process.

To enable the drying step of the process to proceed in an efficient and advantageous manner, it has been found that it is particularly helpful to form the raw material into physical structures of predetermined configuration. In accordance with this inventive process, it is particularly advantageous to form the raw material into pellet-form configurations that are of a size and shape that is particularly conducive to effecting vaporization of the moisture, either on the exterior of the pellets or vaporizing moisture that is contained interiorly of those pellets.

In accordance with this invention, the raw material is thus first formed into pellets that are of a size which is dependent to a great extent upon the characteristics of the material that is being processed. A typical pellet configuration and size may be of elongated rod-shape having a diameter of the order of ⅛–⅜" and a length in the range of ½–2". The pellets may be of larger size in diameter than the typical size described and, dependent upon the characteristics of the particular material, may be a rod-shape structure of a diameter that is of the order of ½". Again, the length of the pellets is dependent upon the characteristics of the material and is determined to be of a size for the pellets to readily adapt to the following drying operation. In the case of some materials, the pellets may be substantially longer than 2 inches and some materials have been dried in accordance with this inventive process with the pellets being up to 12 inches in length.

Figure 2:
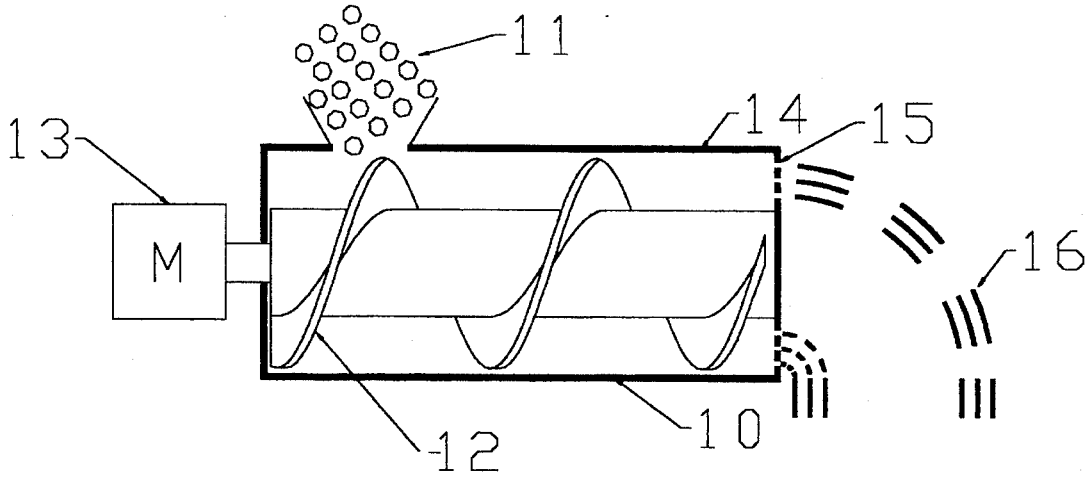
FIG. 2 is a diagrammatic representation of a pelletizing apparatus for effecting formation of the material into pellets in practice of the process of this invention.

Physical forming of the material into pellets during this initial stage of the processing operation can be effected by mechanical apparatus such as a conventional meat grinder mechanism. A conventional meat grinder mechanism is diagrammatically illustrated in FIG. 2. This mechanism comprises a structural housing 10 of elongated cylindrical configuration and having an inlet 11 provided at one end through which the raw material is fed into the interior of the housing. Positioned within the housing is an auger 12 which is supported to extend longitudinally through the elongated housing and operates to mechanically force the material from the inlet 11 to the opposite end by rotation from a driving mechanism 13 such as an electric motor. Rotation of the auger 12 not only causes the material to be displaced longitudinally through the housing, but it also effects initial compaction of the material. The material is moved by the auger to a discharge end 14 of the housing which is provided with an extrusion plate 15. That extrusion plate is formed with a number of orifices 16 through which the material is forced by operation of the auger. This extrusion plate 15 thus constitutes a forming die having a number of orifices through which the material is caused to flow. The material, as it is extruded through the orifices, is formed into strands of material that have a characteristic texture as determined by the particular material and the compacting force that is applied in causing the material to extrude through the respective orifices This apparatus, which is termed a "pelletizer", may be oriented with the auger supported horizontally. This orientation results in the material being extruded through the orifices 16 of the extrusion plate 15 in a horizontal direction as it initially exits from the grinder. The material is compacted into a textured mass that tends to remain in continuous strands, but as indicated in FIG. 2, the strands are otherwise not supported and thus are permitted to fall from the extrusion plate. The solids in the raw material are or become relatively small size particles when forced through the orifices 16. As a consequence of the pressure created during the extruding operation, these particles of solids compact with adjacent particles in an adhesively and mechanically secured mass that tends to maintain a continuous strand configuration.

This step of the process is termed "pelletizing" with the material being processed through an apparatus characterized as a pelletizer. In view of this step of the process also initially effecting forming the material into particles having a maximum size as determined by the size of the orifices in the extrusion plate, this step of the process can be termed "texturizing". The particles extruded through orifices, regardless of size, are formed into a compacted mass which, because of the independent nature of the particles that retain their separate identity, have a textured composition and are not an integral mass. Consequently, this step of the process can be termed texturizing, with that operation being effected by an apparatus termed a "texturizer". The grinder mechanism diagrammatically illustrated in FIG. 2 is one mechanism that performs this pelletizing or texturizing function, but it is to be understood that other apparatus may be utilized to perform the functions of comminuting the raw material and compacting it into a textured mass. It is not the purpose of this description to identify and describe other apparatus that is also suitable for performing this step of this inventive process. The terms "pelletizer" and "texturizer" are to be considered equivalent in this description and claims as are the terms "pelletizing" and "texturizing".

The material, as it leaves the extrusion plate 15, is initially in the nature of continuous strands, but the weight of the material will result in separation of those strands into short length pieces. Depending upon the moisture content and characteristics of the material, those strands will tend to break into relatively short length pieces in the range of ½ to 2" in length. The length is dependent upon the characteristics of the material, the moisture content and, in particular, the adhesive characteristics of the material. The adhesive and mechanical bonding of solids particles does not provide a strong interconnection and the strand will separate or break up as a consequence of its own weight if simply permitted to fall from the extrusion plate. If desired, auxiliary apparatus may be provided to separate the strands into pellets of predetermined, uniform length, or to obtain pellets of greater length, such as of the order of 12 inches.

A pelletizing apparatus in the form of a conventional meat grinder is to be understood as being illustrative of suitable apparatus for forming of the pellets. Other mechanisms may also be employed to effect formation of the pellets. Such apparatus, regardless of its mechanical structure, is designed to effect compaction of the material to a desired degree and effect forming of the material into strands. It will also be understood that a pelletizing apparatus may be oriented other than horizontally as shown in FIG. 2. For example, the apparatus may be disposed in a manner to extrude the material through a respective forming die or extrusion plate in a vertically downward direction or it may be oriented and constructed to extrude the material into strands in various directions other than axially in a horizontal direction as with a typical meat grinder as shown in FIG. 2.

The moisture content of the material, as it is passed through the pelletizer, and the content of the material as it is extruded, is of a critical value for performance of the process. Material that has very high moisture content cannot be formed into pellets and if the moisture content is sufficiently high, the material would most likely merely flow as a semiliquid through the pelletizer and exit from the extrusion plate without any definite physical formation. In contrast, the material that is introduced into the pelletizer must have sufficient moisture to enable it to be formed into pellets. Material that is relatively low in moisture may be so dry that it cannot be forced through the extrusion plate. This, again, is dependent not only on the moisture content, but also on the diameter size of the orifice and the intended size of the pellets.

Assuming that the moisture content of the material is neither too high or too low according to the two criteria discussed in the preceding paragraph, it is essential that the moisture content be of a proportion such that the material can be formed into pellets, but that those pellets do not exhibit an excessive "sticky" characteristic. Specifically, the moisture content of the material must be of a sufficiently low value that the formed pellets will not exhibit a strong tendency to adhere to each other when placed in contacting engagement. The moisture content is critical in this respect as the drying step of the process is best effected if the pellets, after they are formed and as they enter the dryer, do not adhere to each other or, in effect, agglomerate into relatively large masses that would prevent or seriously impede circulation of heated, drying air around the pellets.

Whether the material has a moisture content that is of an acceptable value for forming into pellets and being subjected to drying in the dryer is determined by trial and error tactics. Experience is perhaps the best basis for determining whether the raw material can be formed into pellets by a particular pelletizing apparatus. Whether the material has an acceptable moisture content may also be initially determined by a simple "hand" test. This is accomplished by taking a small quantity of the material, rolling it into a ball, and passing that ball from hand to hand. If the ball retains its shape and does not tend to strongly stick to the hand, the moisture content may be of an acceptable value. If this "hand" test indicates that the moisture content is too high, it may be necessary to use a modification of the basic process, namely, the process as illustrated in FIG. 4 and as described with respect thereto.

Figure 3:
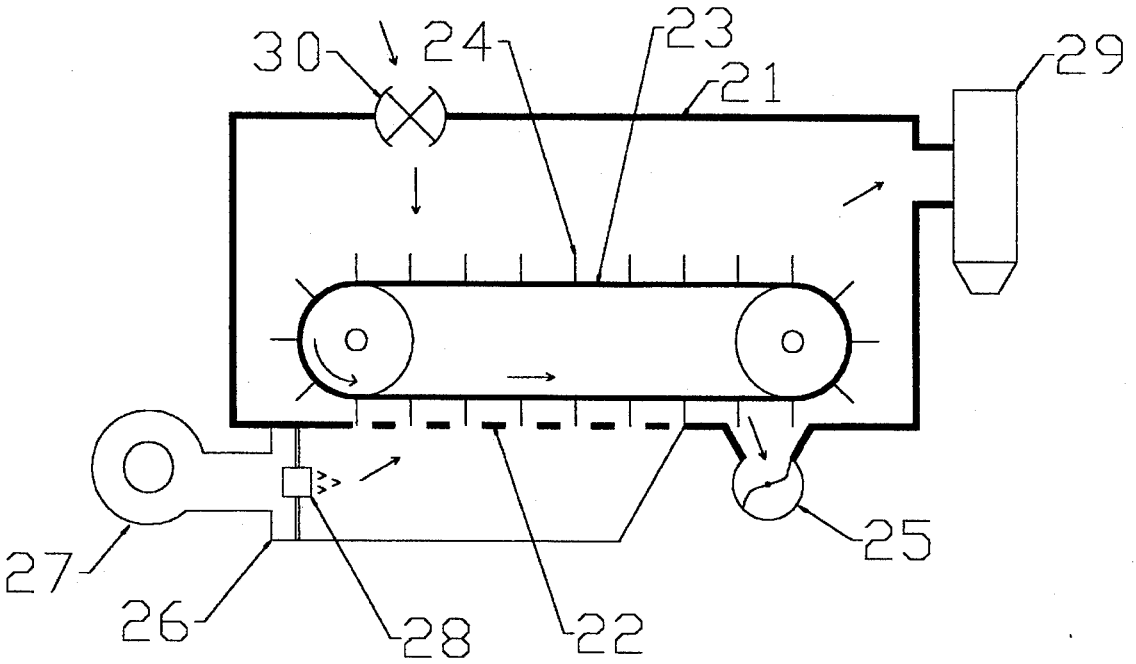
FIG. 3 is a diagrammatic representation of a dryer apparatus for effecting drying of the formed pellets of the material in performance of the process of this invention.

Following formation of the pellets, as a consequence of the mechanical operations performed by the pelletizer 5, the pellets are placed in a layer on a bedplate of a drying apparatus. This drying apparatus may be of various types and constructions, but, in general, it is of a design that produce a flow of heated air through the layer of pellets and effects fluidization of the layer. An example of a typical apparatus that is well-suited for performance of this aspect of the process is disclosed in U.S. Pat. No. 5,161,315, which is an invention of one of the co-inventors of this process. That drying apparatus is diagrammatically illustrated in FIG. 3 of the drawings of this disclosure. Details of the structure and its functioning can be ascertained by reference to the foregoing identified patent. In general, the structure comprises a treatment chamber 21 having a bottom bedplate 22. That bedplate is formed with a large number of small size apertures through which heated air may pass upwardly and through the layer of pellets passing over the top of the bedplate. The material to be dried in the form of pellets is introduced into the chamber at an inlet end such as adjacent the left end of the diagram and is caused to move longitudinally over the bedplate by a mechanism such as an endless chain-type conveyor 23 provided with a number of flights 24. The pellets are discharged at the right end of the treatment chamber through a discharge mechanism 25. Heated air is introduced into the treatment chamber from an air supply source 26. That air supply source is disposed in underlying relationship to the bedplate 22 and includes a fan or blower 27 which induces a flow of air from the exterior environment and into the treatment chamber. A heating unit 28 is included in downstream relationship to the fan 27 and is operable to elevate the temperature of the air to a desired point suitable for effecting the drying operation. Air is exhausted from the treatment chamber through a mechanism such as a cyclone separator 29. The pellet form materials may be introduced into the treatment chamber 21 through a mechanism 30 which will effect uniform transverse distribution of pellets across the bedplate while forming an air lock at the entrance end and thus enhance the efficiency of the treating apparatus.

The pellets, as they pass through the treatment chamber, are subjected to air heated to an elevated temperature of predetermined magnitude suitable for effecting the drying operation. The temperature to which that air is elevated depends upon the particular material that is being processed. Additionally, the treating apparatus illustrated is advantageous in that it effects levitation of the pellets as they traverse over the bedplate and form a fluidized layer of pellets. This levitation is caused by air introduced in quantities and inlet velocities through the bedplate which will effect the desired levitation. Providing a treatment chamber of sufficient length for the particular airflow and temperature for the specific material will effectively vaporize the moisture contained on and within the pellets to produce the desired degree of drying.

In accordance with a second major aspect of this invention, an aspect which was generally described in the Summary of the Invention, the process is advantageously utilized in drying materials that have a relatively high moisture content. For example, it is possible for this process to be utilized in effecting drying of material having a moisture content extending up into the range of 50–70%. Utilization of this inventive process for effecting drying of materials having a moisture content in the indicated range is enabled by using the initial step of mixing the raw material with a material that is already in a relatively dry state. For example, the added material may either be the dried raw material or it may be a different type of material, depending upon the specific purposes and objectives to be obtained through drying of the material and for the purpose with which it will be utilized. An example of such a raw material which can be processed by this inventive process is a relatively high content liquid material such as milk whey. Previously dried milk mixture may be ground into relatively small particles and readily added to the raw material liquid whey to produce a mixture that is capable of being processed in accordance with the technique of this invention. The amount of dry material to be added to raw material of high moisture content is determined by considering the criteria and factors previously discussed. In general, the objective is to reduce the moisture content of the material to be introduced into the pelletizer to a proportion where the mixture can be formed into pellets, such as by the extrusion technique, but the formed pellets will exhibit minimal tendency to adhere to each other.

Use of this process to dry milk whey or similar high moisture content raw material is diagrammatically illustrated in the flow process diagram of FIG. 4. As a first step in this process technique, the raw material is combined with a dried material in predetermined proportions to obtain a mixture which will be suitable for forming into pellets in accordance with the procedure that was previously described in the basic concept and in accordance with the flow process as shown in FIG. 1. In this FIG. 4 process flow diagram, the dried constituent is shown as being obtained from the end product, but it will be understood that when beginning the process operation, that dried material from a separate source must be first added to the raw material. However, once the process has been initiated, then there will be dried product produced at the terminal end of the process and a portion of that dried product can then be processed and utilized for intermixing with the raw material. It will also be understood that a different dried material, rather than that which is obtained as the end product of a process technique, may also be utilized for intermixing with the raw material. This is illustrated in FIG. 4 as either an alternative or as a combination type introduction of a different constituent into the process at the mixing stage.

A suitable apparatus generally designated as a mixer 40 is shown in this diagrammatic flow process diagram. This mixer may be of any appropriate type mechanism such as an auger-type mixer or a paddle-type mixer, both of which types are frequently used in processes for effecting mixing of two or more materials. It is only essential that the mixer 40 be of a type which will effect uniform mixing of the materials so that the output from the mixer will be uniformly blended.

The quantities of raw material and dried material are selected in proportions such that for the moisture content and characteristics of the raw material the mixed product will have a consistency and characteristic such that it can be formed into pellets that will not readily adhere to each other and maintain the desired separation as described in conjunction with the basic process of FIG. 1. This mixed material is then fed into a pelletizer 41 which will form the mixed material into pellets of the desired shape and size. This pelletizer may consist in its basic form of a mechanical mechanism such as a typical grinding apparatus such as that of FIG. 2 which effects compaction of the material while causing its extrusion through a forming die which is in the nature of an extrusion plate at the discharge end of the grinder. As in accordance with the previously described basic technique, the pelletizer will generate strands of the material which are permitted to simply drop or fall into the inlet mechanism of a suitable dryer apparatus 42. This dryer 42 may advantageously comprise a structure similar to that illustrated in FIG. 3 and described in general terms herein. As in accordance with the first described process technique, the pellets produced by the pelletizer 41 and introduced into the dryer 42 are in an undried state having a significant moisture content. However, the moisture content is such that the pellets will not readily adhere to each other and, thus, will not readily form into a large size mass of material through agglomeration. The dryer operates in the general fashion as described and through the techniques of levitation of the pellets and passing of heated air through the pelletized material will effect further removal of moisture from the pellets. The length of time that the pellets are processed in the dryer depends upon the characteristics of the material and also the temperatures and quantities of air that are passed through the bed of pellets in the dryer.

The dried pellet-form material that is discharged from the dryer 42 is the end product which may then be transported to a point of utilization or may be subject to further processing to produce a desired material. The product as discharged may be relatively high in temperature and may advantageously be subjected to a cooling operation before it is ultimately packaged into suitable containers, or stored, or subjected to further processing. Whether the dried pellets upon discharge from the dryer need be subjected to cooling is dependent upon the requirements of subsequent processing techniques or the storage and packaging procedures. Cooling may be effected by passing the pellets through appropriate apparatus capable of accomplishing cooling of the pellets to a desired temperature within a specified time period. Subsequent processing of the end product is not a part of the inventive process and is not further described nor is it illustrated in the process diagram of FIG. 4.

In accordance with this flow process, as illustrated in FIG. 4, a portion of the dried pellets discharged from the dryer 42 are utilized as dried material for return to the mixer 40. To enable utilization of the dried pellet product, those pellets are first subjected to a cooling step by passing them through suitable apparatus such as a cooler of appropriate design indicated at 43. The cooler 43 is advantageously designed to reduce the temperature of the dried pellets which may be at a temperature of 150 or 200 degrees Fahrenheit and then subjecting those particles when cooled to a grinding operation. After cooling, as is indicated in FIG. 4, the cooled pellets are introduced into a suitable grinder 44 to effect a reduction in the particle size to that which is then suitable for intermixing with the raw material.

The process of this invention has been described as useful in drying of materials that, while in a raw state, have a moisture content that may be of the order of 20% or up to the range of 50–70%. The higher moisture content materials are adapted to processing according to the technique as is illustrated in the flow diagram of FIG. 4. However, utilization of the process of this invention is not limited to materials which have a moisture content that may be, as a maximum, of the order of 50–70% as the process can be utilized with certain materials that are essentially liquid, or which may be considered for purposes of explanation as having a moisture content of the order of 95%. A material that is essentially liquid cannot be formed into pellets as it would merely flow through the orifices of an extrusion plate. It is obvious from the preceding discussion of the problems of forming the pellets from a material such that they will not agglomerate, that a raw material having a 95% moisture content is not readily adapted to the process or drying. By addition of one initial procedural step to the process as is shown in FIG. 4, it does become possible to utilize the process of this invention in drying of materials having such a high moisture content. In particular, the process may be utilized with materials that, while liquid, also exhibit a characteristic feature of coagulation and can, therefore, be transformed from essentially a liquid state into a semiliquid state. Examples of material of this nature is the blood by-product obtained from slaughterhouse operations and also in the nature of eggs that are inedible for consumption or human use. Blood from a slaughterhouse operation could be utilized as a constituent in feed products for animals provided it could be economically dried to a state where it could be intermixed with other nutrient materials and form a suitable feed product for livestock.

The process of this invention having this added initial procedural step of coagulating of the raw material is diagrammatically illustrated in FIG. 5. The process, as shown in the FIG. 5 diagram, is essentially the same as that shown in the FIG. 4 flow diagram, but includes the initial step of coagulation.

The process as shown in FIG. 5 includes the additional step of first subjecting the liquid raw material to a suitable procedure to effect its coagulation. Accordingly, the raw material in its essentially liquid state is first fed into an apparatus that is appropriate for the particular material and operated in a manner to effect its coagulation. For example, the process, as shown in FIG. 5, includes a coagulator apparatus 50. The coagulator apparatus 50, as an example, may comprise a structure including a coil mechanism which is positioned in an apparatus for effecting transfer of heat to the coil and then to elevate the temperature of the liquid material introduced into the coagulator and passed through the coiled mechanism of the coagulator. In particular, such a typified apparatus may consist of a coiled arrangement of fluid conduits which is incorporated in a heating mechanism that is capable to effect elevating of the temperature of the raw material to a temperature of the order of 165–220 degrees Fahrenheit. With material passing through the coagulator coils for a period of time that is sufficient to enable the heat to be absorbed by the material, the apparatus will be effective in transforming a liquid material such as blood or inedible poultry eggs to a point where they are transformed from that liquid state into a soft semisolid state.

During passage through the coagulator 50, the material, as a result of being heated to a temperature of the order of 165–220 degrees Fahrenheit, will also be effective in forming water vapor as a consequence of an evaporation process that simultaneously occurs. Thus, the liquid material, after it passes through the coagulator, will exit in two phases, namely, a semisolid gel and also as steam. The steam is permitted to simply exhaust to the atmosphere and is not retained with the coagulated material for the remainder of the process.

The coagulated material, in the state as it exits from the coagulator 50, will have a moisture content that will generally be in the order of 80% by weight for the described materials. That coagulated material obviously cannot then be subjected to the pelletizing operation as it is in such a liquid state that it will not be capable of forming into pellets. Accordingly, the process, as shown in FIG. 5, also includes a mixing step where the coagulated material is intermixed with a dried material such as the dried product that will result from the process and which is ground up into small particles to facilitate intermixing. Again, the mixer, indicated at 51, may be of an auger or paddle-type and by appropriate percentage combining of the coagulated material and the dried material, will result in forming of an intermediate material that will be of a moisture content adapted to be formed into pellets. The process of this invention, as shown in FIG. 5, subsequent to the mixer operation, is essentially the same as that described in conjunction with the process flow diagram of FIG. 4. Accordingly, the process as shown in FIG. 5 next passes the intermediate material from the mixer 51 through a pelletizer 52. That pelletizer also functions to form the material into strands that are broken up into relatively short length pieces and comprise the undried pellets. Those undried pellets then are passed through a dryer 53 similar to that previously described in conjunction with FIG. 3. The pellets, when they exit from the dryer 53, are in a dried state that can form the ultimate end product for transport to a utilization site or, in the case of certain materials, for ultimate disposal. A portion of the pelletized material exiting from the dryer 53 is caused to pass through a cooler 54 to reduce the temperature to a level that is more conducive to subjecting the pellets to a grinding operation. The cooled pellets are then passed through a grinder 55 and the particles are returned to the mixer 51 for intermixing with additional new material from the coagulator 50.

The process, as diagrammatically illustrated in FIGS. 4 and 5, utilizes a particular flow path for the materials as they progress through the systems. That particular flow path may be altered in accordance with characteristics of the materials and, in particular, of the type of materials that exit from the dryer and as to their further processing that may be required such as for returning portions of the dried pellets to the raw materials as shown in FIG. 4 or for intermixing with the coagulated material at that particular stage as shown in FIG. 5. For example, the pellets as they exit from the dryer may be returned directly to the mixer in the FIG. 4 schematic or to the mixer as shown in the FIG. 5 schematic. It is not necessary that the pellets be routed through a cooler or even through a grinder. This depends upon the characteristics of the pellets and the raw material as to whether it is necessary that the pellets, as they exit from the dryer, require cooling or mechanical operations to reduce their size. Reduction in size of the pellets has the beneficial advantage in certain cases of facilitating the intermixing with the raw material or other materials. Similarly, it may not be necessary to effect cooling of the pellets before intermixing them with the raw materials or the materials that are obtained from the coagulation process in FIG. 5. The material exiting from a coagulator will normally have a relatively high temperature and, thus, it is immaterial that the return material that has been dried be first cooled. Similarly, as indicated, it is dependent on the characteristics of the material as to whether it is necessary that the pellets be first ground or reduced in size to particles that would be more adaptable to intermixing to form a uniform mixture that is routed through the pelletizer. It will also be noted that while the flow diagrams of FIGS. 4 and 5 indicate that the dried pellet material will be routed through a grinder, the apparatus may be of a different function. For example, an apparatus may be provided which does not necessarily grind the pellets, but merely mechanically operates on the pellets to break them up into smaller size particles. Also, although not illustrated or otherwise described, it will be understood that the dried pellets, before being returned for intermixing with the raw material or the coagulated materials, may be subjected to other processing and, for example, may be subjected to a process whereby other materials may be introduced to provide other added value to the end product.

Cooling of the material after it passes through the dryer is an added step that is beneficial in processing some products, particularly products having a high sugar content. In processing of milk whey, it is important to cool the dried pellets after they exit the dryer because those pellets, when hot, are sticky. It is merely essential to cool such products before they can be further handled with any degree of efficacy.

It has been previously noted that the process, as practiced in connection with a flow system such as shown in either FIG. 4 or FIG. 5, is functional to enable the process to work in connection with materials that have moisture content that may be well within the range of 50–70%. This ability to handle materials with such moisture content was indicated to be best handled by adding dried material to either the raw material of high moisture content or to the coagulated material as in the case of FIG. 5. However, it is not necessary in all cases for all materials to utilize this mixing process even when the raw material may have a relatively high moisture content that may be of the order of up to 70%. There are some materials that have been processed in accordance with the process of this invention having raw materials with moisture contents of the order of 70% without having to first, as an initial step, mix a dried material with the raw material to reduce its moisture content. Whether this mixing step can be omitted is determined by the characteristics of the particular raw material. There are some raw materials which, even though they have a high moisture content, can nevertheless be subjected to a pelletizing operation and form pellets which, while having sufficient structural integrity and ability to be extruded through a pelletizing extruder plate, will still not result in undesirable adhering as between adjacent pellets as a consequence of moisture content.

The mixing step, in connection with the process as illustrated in FIG. 4 or FIG. 5, has been indicated as the addition of a dried material to the raw material at the mixing stage. That dried material has been described as advantageous for effecting a reduction in the relative proportion of moisture. It will be understood, however, that the material added at the mixing stage may be other than a dried material. For example, the material that is added to the raw material or the coagulated material, may have a significant moisture content. To enable the process to proceed, it is only necessary that the total moisture content of the material exiting from the mixer and being routed to the pelletizer be of a proportion that will enable it to be formed into pellets with an appropriate moisture content that will avoid the undesirable adhesion of adjacent pellets to each other. Not only may the material that is added at the mixing stage to the raw material be either dried or have a significant moisture content, but the material that is added may also be of a type or kind that will add a constituent of value to the raw material and, thus, form a combination that is particularly suited for ultimate utilization after it is formed into dried pellets.

In describing the process, as is illustrated in FIG. 4, it was previously noted that the process was initiated by first obtaining dried material that was the raw material dried by other techniques or processes. After a sufficient amount of the raw material in a dried state was obtained, it could then be introduced into the system and maintain continuity of processing without having to resort to techniques to obtain the dried material. An objective that is achieved through use of material that has been previously dried by other techniques for introduction at the mixing stage has the advantage in that the resultant product will be of a pure state that is of characteristics dictated by the raw material.

An alternative technique that can be employed to ultimately result in the end product having the same characteristics as the raw material, other than the absence of moisture, can be effected through use of a dried material having different characteristics than the raw material. For example, a material such as oat or rice hulls can be introduced or combined with the raw material at the mixing stage, even through the raw material has different characteristics and it is desired that the ultimate dried product have only those characteristics exhibited by the raw material. This technique involves first adding the dry oat hulls or rice hulls at the mixing stage and to then pelletize that mixture and subject it to a drying operation. The dried pellets, which thus then comprise a mixture of the raw material and the oat hulls, is returned to the apparatus at the mixing stage and again recombined with the raw material to obtain a mixture that can be further processed. This technique of returning the combination dried material through a number of cycles will ultimately effect a reduction in the total amount of the oat hulls that will be contained in the mixture. Through a number of sequential recyclings, it is possible to then reduce the proportion of oat hulls in the dried product that is discharged from the dryer to a point where it ultimately of a percentage that is either acceptable or will be effectively reduced to a negligible or zero amount.

A major objective achieved through utilization of the drying process of this invention is the ability to effect economical and commercially feasible drying of many types of material. While many materials are capable of being dried in accordance with prior practice and apparatus, such drying techniques, as have been heretofore employed, invariably result in cumbersome and complicated techniques and procedures as well as substantial increased energy costs. As a consequence, many materials, while they may have been capable of being dried for disposal or other utilization, have simply been subjected to disposal operations where they were not further utilized. Such typical disposal operations may have included placement in landfills or disposal in sewage disposal systems.

An example of the economic advantages obtained by employment of the inventive drying process is easily demonstrated in the case of the inedible eggs. Such eggs cannot be readily disposed of because of chemical and bacteriological considerations and, thus, it has been the general practice to dry the inedible eggs in an apparatus designated as a "spray dryer". A typical spray dryer has the raw materials injected into the apparatus which primarily consists of a heat generating device. A large quantity of heat is required to effect drying by such an apparatus and, as a consequence, the processing of inedible eggs by a spray dryer may well approach a cost of $400.00 per ton. As a contrast of utilizing the drying process of this invention, the cost of drying inedible eggs can well be in the order of about $50.00 per ton. This represents a very significant economical advantage. This minimization of the cost of drying materials is also experienced with other materials which are subjected to the drying process of this invention.

The inventive process also has significant value in that it enables many materials to be economically processed by drying to form products that have substantial utility or which may be disposed of in advantageous manners. This process enables materials that may otherwise simply be subjected to disposal operations to be formed into useful products and, thus, enhance the economic situation as to disposal of such materials. An example of such a product is the formation of fuel pellets by combining waste paper sludge with coal dust. The drying process will result in the waste paper sludge which is of a relatively high moisture content being capable of combining with the coal dust into a dry, solids product and, thus, form a highly useful fuel product.

This invention is not limited in its usefulness to drying of products that may have a basic organic nature. The process can also be utilized in drying of products which are not organic in nature. As an example, the process is well-suited to processing of sulfate materials to effect drying and combination with other plant nutrient materials to form a fertilizer.

This process, as indicated, is adapted to drying of materials that are chemical based in nature. The process can be utilized, either in its basic form as shown in FIG. 1, or it may be utilized in a process of either modification as shown in FIGS. 4 or 5. Chemical based materials may be subjected to the same process of being mixed with dried constituents at an initial stage in the process, as shown in FIG. 4, or the raw material may be subjected to a process that is equivalent to coagulation. Specifically, in the case of chemical products, the raw materials that may be in a very high moisture state can be subjected to an operation that is best described as "chemical agglomeration". That may be similar to coagulation in that it may be induced through addition of heat to the raw material to effect a reduction in the amount of moisture. This technique basically comprises vaporization of a certain quantity of the moisture. As in the case of coagulation, the objective is to avoid utilization of extreme high quantities of heat energy to effect vaporization. The objective is to utilize only sufficient quantities of heat energy to reduce the moisture content to a point where the agglomerated chemical raw materials may be subjected to a mixing operation with previously dried materials, whether of the same character as the raw material, or of a different kind.

The foregoing description has referred to certain temperatures for effecting the processing of the materials. Those temperatures are to be considered as exemplary, even for the particular materials with which they may refer. Temperatures, at various stages of the process, will be in accordance with characteristics of the specific material that is being processed. Even a same material may have variations in its characteristics that different temperatures may be more appropriate. Similarly, the time of operation at any stage, such as in the dryer, is dependent upon the moisture content, the amount of material that is caused to move through the dryer, as well as other factors that may affect the time that the material must be subjected to a drying operation along with the temperature and airflow that may be caused to pass through the layer of material.

A large number of materials have been tested in performance of the described process. A number of these materials are listed in the following table to provide a better example of the utility and versatility of this process. (See table on page 26)

PRODUCTS TESTED USING THE PROCESS OF FIGS. 1, 4 OR 5

| PRODUCT DESCRIPTION | MOISTURE CONTENT % BY WEIGHT IN | OUT |
|---|---|---|
| ALFALFA | 60 | 6 |
| AMINO ACID | 18 | 0 |
| BAKERY WASTE | 37 | 10 |
| BLOOD/CHICKEN AGGLOMERATED | 90–86 | 7 |
| BREWER'S GRAIN 35%, SOYMEAL 30%, LACTOSE 35% | 49 | 6 |
| CARROT WASTE | 82 | 8 |
| CHICKEN MEAT | 64 | 4 |
| CITRUS WASTE | 78–82 | 11 |
| COTTON WASTE | 24 | 1 |
| CRABMEAT & SHELLS | 74 | 1 |
| EGG SHELLS FROM BREAKING PLANT | 15–22 | 2 |
| FLY ASH | 24 | 1 |
| GRASS CLIPPINGS | 71 | 10 |
| INEDIBLE EGG | 90 | 10 |
| OIL SLUDGE FROM OIL WELL | 27 | 4 |
| PAPER SLUDGE 60%, COAL FINES 40% | 34 | 6 |
| RESTAURANT WASTE | 70 | 10 |
| SLUDGE BNNR (LOCOMOTIVE OVERHAUL BASE) | 76 | 6 |
| SPENT HENS (GROUND & ENZYME TREATED) | 48 | 6 |
| SPENT HENS/SOYMEAL | 38 | 14 |

The process does provide a technique for effecting drying of these various materials. Particulars as to the processing of any of the materials is not otherwise described than indicating the proportion of moisture of the raw material as compared to the moisture content of the dried pelletized form of the material. Temperatures and time of processing are matters that are determined with reference to the specific material and are variable in accordance with specific characteristics of a particular material. Accordingly, processing temperatures and times are considerations and factors that are best determined by trial and error as to any specific material and these are adjusted in accordance with the specific moisture content of any particular material. It is to be understood that this listing of materials tested in the process of this invention is not exhaustive and other materials are also well-suited to drying by this process.

It will be readily apparent from the foregoing detailed description of the inventive process that a novel and highly useful technique is provided for effecting drying of many diverse materials. The process, in its basic form, effects the formation of the raw materials into a solid configuration having an appropriate moisture content and to then effect drying of the formed pellets by means of a dryer having appropriate airflows at temperatures which effect the levitation of the pelletized materials and the vaporization of moisture from either the interior or from the exterior of those pellets. This process is of particular advantage in comparison to prior techniques in that it utilizes substantially less energy to effect the drying operation.

Having thus described this invention, what is claimed is:

1. A process for drying of raw materials that consist of solids and a substantial proportion of moisture comprising the steps of:

1) mixing the raw material with a relatively dry material of characteristics different from that of the raw material and in proportion according to their relative moisture contents to obtain a predetermined quantity of a combination material having a moisture content enabling processing in accordance with the following steps 3 through 6;

2) processing the combination material in accordance with the following steps 3 through 6 producing dried pellets of the combination material;

3) extruding the combination material through a forming die into one or more strands that are each of a predetermined cross-sectional area having the solids compacted into a cohesively secured mass;

4) separating each strand that is formed into elements of selected lengths forming rod-shaped pellets;

5) depositing the pellets at a first point on an upper surface of an elongated supporting plate that is formed with a plurality of apertures through which air is caused to flow, forming the deposited pellets into a layer of predetermined thickness and displacing the pellets at a selected velocity over the supporting plate to a second point spaced a distance from the first point and which second point the pellets are removed from the plate;

6) passing heated air upwardly through the apertures in the supporting plate and the layer of pellets being displaced thereover at a temperature and volumetric rate that affects vaporization and removal of the moisture carried by the pellets to reduce the moisture content of the pellets to a predetermined weight percentage during the time they are being displaced over the supporting plate;

7) mixing pellets of combination material that have been dried by preceding step 6 with raw material in a second cycle and repeating the process to affect a reduction in the proportion of the dry material in the resulting pellets, repeating the cyclic process until the proportion of the dry material in the dried pellets is reduced to a predetermined proportion.

2. A process for drying of raw materials that consist of solids and a substantial proportion of moisture comprising the steps of:

1) mixing the raw material with a relatively dry material of characteristics different from that of that of the raw material and in proportion according to their relative moisture contents to obtain a predetermined quantity of a combination material having a moisture content enabling processing in accordance with the following steps 3 through 6;

2) processing the combination material in accordance with the following steps 3 through 6 producing dried pellets of the combination material;

3) extruding the combination material through a forming die under a selected pressure into one or more continuous strands of predetermined cross-sectional area and compacting the solids extruded through the forming die into a cohesively secured mass;

4) separating each strand that is formed into elements of selected length thereby forming rod-shaped pellets;

5) depositing the pellets at a first point on an upper surface of an elongated supporting plate that is formed with a plurality of apertures through which air can be caused to flow, forming the deposited pellets into a layer of predetermined thickness and displacing the layer pellets at a selected velocity over the supporting plate to a second point spaced a distance from the first point and at which second point the pellets are removed from the plate;

6) passing heated air upwardly through the apertures in the supporting plate and the layer of pellets being displaced thereover from the first to the second point at a temperature and volumetric rate that effects vaporization and removal of the moisture carried by the pellets to a predetermined weight percentage during the time they are being displaced over the supporting plate from the first to the second point; and 7) mixing pellets of combination material that have been dried by preceding step 6 with raw material in a second cycle and repeating the process to effect a reduction in the proportion of the dry material in the resulting pellets, repeating the cyclic process until the proportion of the dry material in the dried pellets is reduced to a predetermined proportion.

* * * * *